US006339903B1

(12) United States Patent
Zambelli et al.

(10) Patent No.: US 6,339,903 B1
(45) Date of Patent: Jan. 22, 2002

(54) SUPPORTING DEVICE FOR PREFABRICATED BUILDING COMPONENTS, PARTICULARLY FOR PREFABRICATED UNITS MADE OF CONCRETE OR THE LIKE, WITH HIGH RESISTANCE TO EARTHQUAKES

(76) Inventors: Sergio Zambelli, Via Stezzano, 28; Benito Zambelli, Via Roma, 44, both of 24050 Zanica (IT)

( * ) Notice: Subject to any disclaimer, the term of this patent is extended or adjusted under 35 U.S.C. 154(b) by 0 days.

(21) Appl. No.: 09/576,132

(22) Filed: May 22, 2000

(51) Int. Cl.[7] ..... E04C 5/12
(52) U.S. Cl. ..... 52/167.1; 52/509; 52/283
(58) Field of Search ..... 52/378, 396, 397, 52/704, 714, 509, 235, 513, 512, 283, 274, 167.1

(56) References Cited

U.S. PATENT DOCUMENTS 4,523,413 A * 6/1985 Koppenberg ..... 52/509 X
4,583,336 A * 4/1986 Shelangoskie et al. .... 52/283 X
5,283,992 A * 2/1994 Morassutti ..... 52/509

FOREIGN PATENT DOCUMENTS

| | | |
|---|---|---|
| DE | 32 06 099 | 9/1983 |
| EP | 0 064 290 | 11/1982 |
| EP | 0 423 660 | 4/1991 |

* cited by examiner

*Primary Examiner*—Richard Chilcot
(74) *Attorney, Agent, or Firm*—Guido Modiano; Albert Josif; Daniel O'Byrne

(57) ABSTRACT

A supporting device for prefabricated building components, particularly for prefabricated units made of concrete or the like, with high resistance to earthquakes, comprising a bush-like seat which is formed in one face of a first unit and a supporting element which is detachably inserted in the seat. One end of the supporting element protrudes from the seat and from the face of the first unit and forms a resting region for a second unit. The device comprises shock-absorbing means which are interposed between the supporting element and the first unit and/or between the supporting element and the second unit.

22 Claims, 3 Drawing Sheets

SUPPORTING DEVICE FOR PREFABRICATED BUILDING COMPONENTS, PARTICULARLY FOR PREFABRICATED UNITS MADE OF CONCRETE OR THE LIKE, WITH HIGH RESISTANCE TO EARTHQUAKES

BACKGROUND OF THE INVENTION

The present invention relates to a supporting device for prefabricated building components, particularly for prefabricated units made of concrete or the like, with high resistance to earthquakes.

It is known that in the field of buildings composed partially or fully of prefabricated units there is the need to adequately support prefabricated units by means of a supporting structure and to anchor the units to the supporting structure.

In some cases, in order to support a prefabricated concrete unit, for example a prefabricated panel, by means of a supporting structure, constituted for example by a pillar or floor slab of a building, appropriate brackets are provided which protrude from the supporting element or from the supported element and are formed monolithically with the supporting element or with the supported element. Such brackets are adapted to engage regions or seats provided for this purpose in the supported element or in the supporting element.

In other cases, the prefabricated units are supported, instead of with brackets formed monolithically with a unit, by means of steel brackets which, during the installation of the units, are welded or bolted to steel inserts embedded beforehand in the units during their production.

In the case of brackets formed monolithically with a unit, problems occur during installation because the brackets offer no way to adjust the position of the supported element with respect to the supporting element unless resorting to solutions, such as for example shims, which lead to poor precision in positioning and are scarcely practical.

In the case of bolted or welded brackets, there are in any case problems during installation since the fixing of the bracket to the supporting element and optionally to the supported element, performed by bolting or welding, is difficult to perform and does not always lead to results which are fully acceptable as regards precision in positioning the supported element with respect to the supporting element.

EP-423,660 in the name of these same Applicants discloses a supporting device for prefabricated units which is substantially constituted by a bush-like seat formed in one face of a supporting unit and by a supporting element which is detachably inserted in the seat and has an end which protrudes from the seat and from the corresponding face of the supporting unit. The end of the supporting element forms a resting region for the supported unit. This device, owing to the particular coupling between the bush-like seat and the supporting element, considerably simplifies the installation of the units, since it requires no bolting or welding operations.

The above device is further provided with adjustment means which allow to vary the position of the resting region for the supported unit with respect to the supporting unit both horizontally and vertically, so as to allow to correctly position the supported unit with respect to the supporting unit very simply and precisely.

This device has proved itself susceptible of improvements aimed at improving its safety in case of seismic events.

SUMMARY OF THE INVENTION

The aim of the present invention is to provide a supporting device for prefabricated building components, particularly for prefabricated units made of concrete or the like, which allows to increase the resistance to seismic effects of the buildings in which it is used.

Within the scope of this aim, an object of the present invention is to provide a device which allows to eliminate or substantially reduce the transmission of stresses produced by an earthquake between the two units that are mutually connected by means of the device.

Another object of the present invention is to provide a device which makes it particularly simple to install the prefabricated units and allows to achieve high precision in the mutual positioning of the prefabricated units that are mutually connected by means of the device.

These and other objects which will become better apparent hereinafter are achieved by a supporting device for prefabricated building components, particularly for prefabricated units made of concrete or the like, which comprises a bush-like seat which is formed in one face of a first unit and a supporting element which is detachably inserted in said seat and has an end which protrudes from said seat and from said face of the first unit and forms a resting region for a second unit, characterized in that it comprises shock-absorbing means which are interposed between said supporting element and said first unit and/or between said supporting element and said second unit.

BRIEF DESCRIPTION OF THE DRAWINGS

Further characteristics and advantages of the present invention will become better apparent from the following detailed description of preferred but not exclusive embodiments of the device according to the invention, illustrated only by way of non-limitative example in the accompanying drawings, wherein.

DESCRIPTION OF THE PREFERRED EMBODIMENTS

Figure 2:
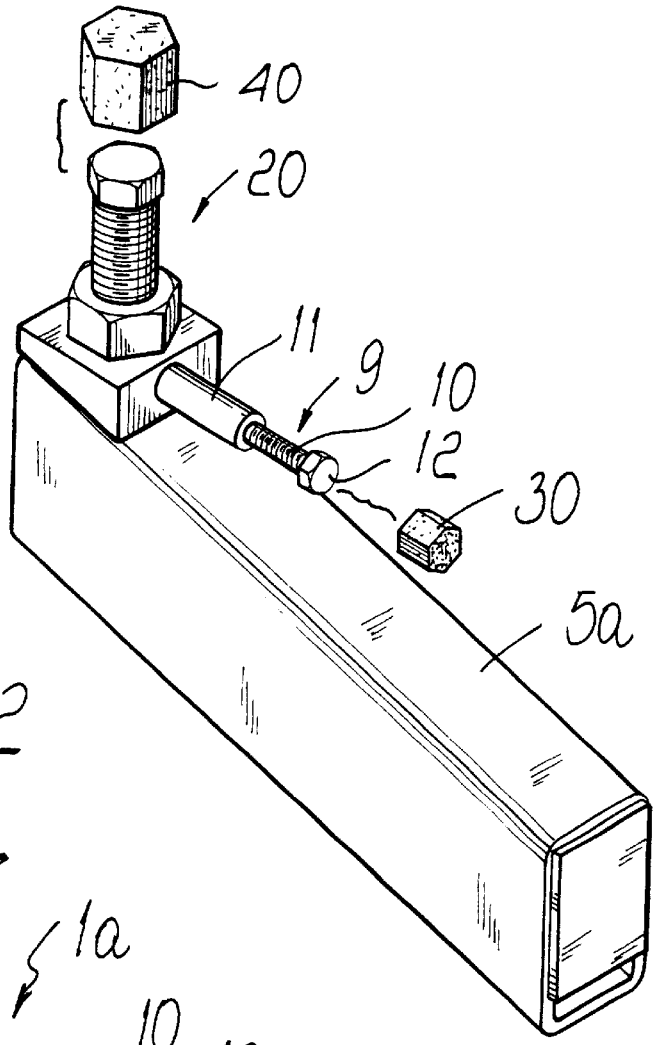
FIG. 2 is a partially exploded perspective view of the supporting element of the device of FIG. 1.

With reference to the above figures, the device according to the invention, generally designated in the various embodiments by the reference numerals 1*a,* 1*b* and 1*c,* comprises a bush-like seat 2*a,* 2*b,* 2*c* which is formed in a face 3 of a first unit 4 and a supporting element 5*a,* 5*b,* 5*c* which is detachably inserted in the seat 2*a,* 2*b,* 2*c* and has an end which protrudes from the seat 2*a,* 2*b,* 2*c* and from the face 3 of the unit 4. The end of the supporting element 5*a,* 5*b,* 5*c* forms a resting region 6*a,* 6*b,* 6*c* for a second unit 7.

According to the invention, the device comprises shock-absorbing means which are interposed between the supporting element 5*a,* 5*b,* 5*c* and the first unit 4 and/or between the supporting element 5*a,* 5*b,* 5*c* and the second unit 7.

The supporting element 5*a,* 5*b,* 5*c* can be moved along the seat 2*a,* 2*b,* 2*c* so as to allow to vary, in a very simple manner, the distance of the resting region 6*a,* 6*b,* 6*c* from the face 3 of the first unit 4.

More particularly, the seat 2*a,* 2*b,* 2*c* is formed by a hollow body 8*a,* 8*b,* 8*c* which is embedded in the first unit 4, which is made of concrete, during its production and is open at the face 3 of the first unit 4.

The seat 2*a,* 2*b,* 2*c* has a polygonal transverse cross-section.

The element 5*a,* 5*b,* 5*c* is preferably constituted by a tubular cylindrical body which also has a polygonal transverse cross-section and can be coupled with play to the seat 2*a,* 2*b,* 2*c*.

The seat 2*a,* 2*b,* 2*c* can extend horizontally, but preferably, in order to achieve better safety against accidental extraction of the supporting element 5*a,* 5*b,* 5*c* from the seat 2*a,* 2*b,* 2*c* during seismic events, it extends in a direction which is inclined with respect to the horizontal so that the supporting element 5*a,* 5*b,* 5*c* is inclined upward from its end that is inserted in the seat 2*a,* 2*b,* 2*c* toward its end that protrudes from the seat 2*a,* 2*b,* 2*c* and from the face 3 of the first unit 4.

The portion of the supporting element 5*a,* 5*b,* 5*c* that protrudes from the first unit 4 is preferably accommodated in a suitable recess 51 which is formed in the second unit 7 during its production, for example by means of a box 52 made of metallic or synthetic material.

Advantageously, the device according to the invention comprises first adjustment means for varying the extent of the portion of the supporting element 5*a,* 5*c* that protrudes from the seat 2*a,* 2*c* and from the face 3 of the first unit 4.

Figure 1:
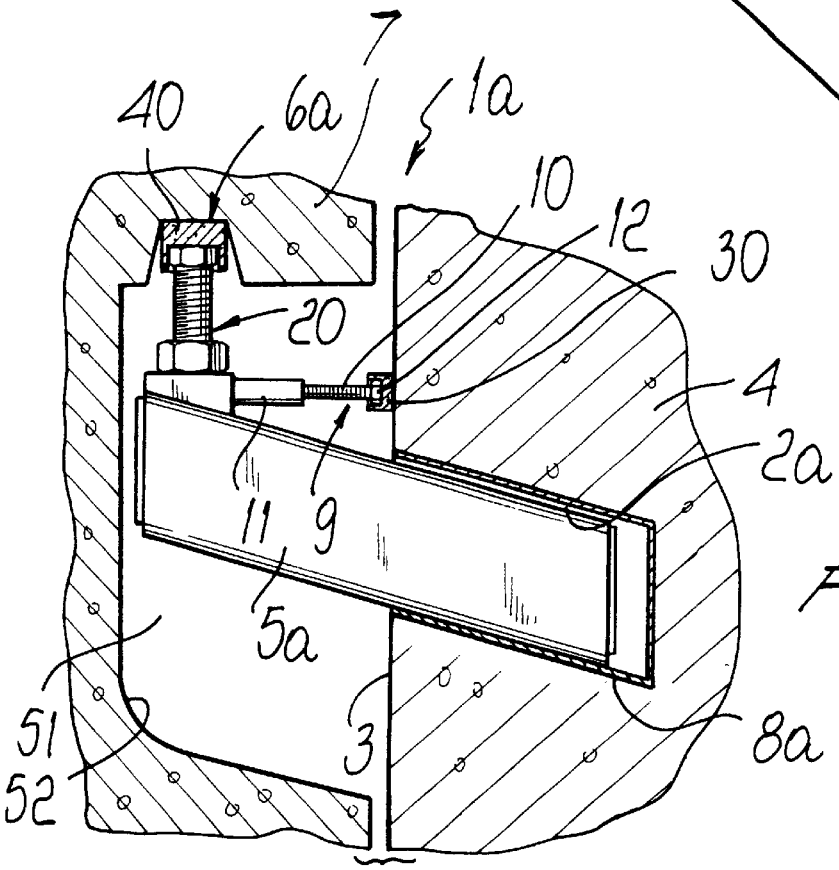
FIG. 1 is a partially sectional side elevation view of the device according to the present invention in a first embodiment.

The first adjustment means, as shown in particular in FIGS. 1 and 2, comprise a first screw element, generally designated by the reference numeral 9, which has an adjustable useful length and is interposed between the portion of the supporting element 5*a* that protrudes from the seat 2*a* and the face 3 of the first unit 4.

More particularly, as shown in FIGS. 1 and 2, the screw element 9 has a threaded stem 10 which couples to a female thread formed inside a bush 11 which lies substantially horizontally and is fixed, for example by welding, to the end of the supporting element 5*a* that protrudes from the seat 2*a*. The threaded stem 10 ends, on the opposite side with respect to the bush 11, with a hexagonal head 12 which can be operated in order to turn the screw element 9 about its own axis with respect to the bush 11, so as to vary the useful length of the screw element 9.

In practice, by operating the screw element 9 it is possible to vary the length of the portion of the supporting element 5*a* that protrudes from the seat 2*a* and accordingly vary the distance of the resting region 6*a* from the face 3 of the first unit 4. In this manner it is possible to vary the distance of the second unit 7 from the face 3 of the first unit 4.

Figure 4:
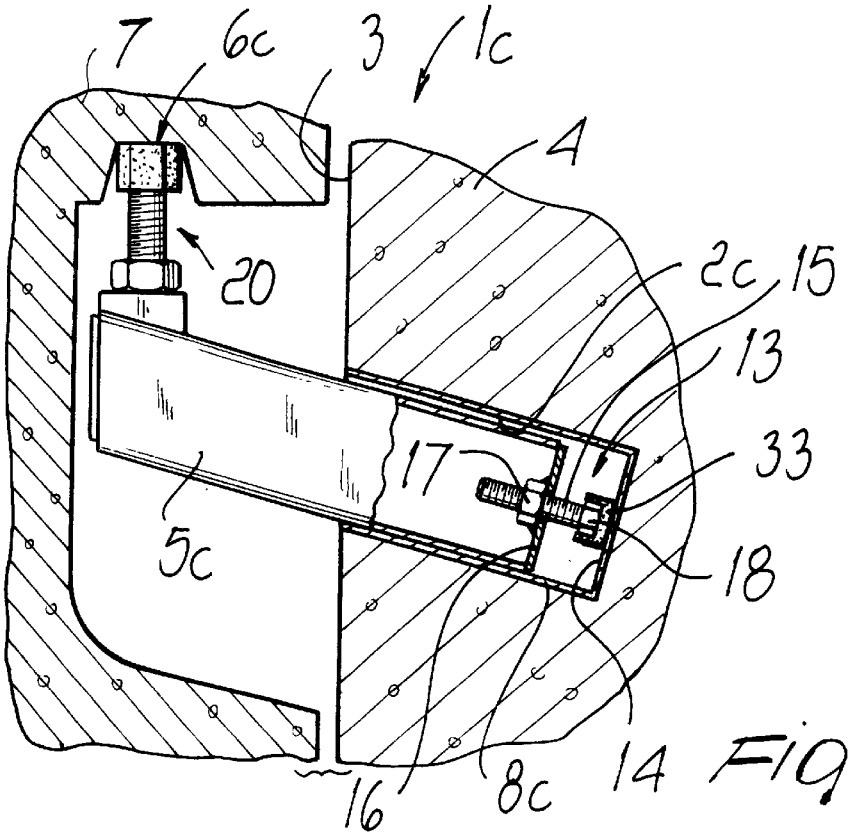
FIG. 4 is a partially sectional side elevation view of the device according to the invention in a third embodiment.

As shown in particular in FIG. 4, the first adjustment means can also be constituted by a first screw element 13 which has an adjustable useful length and is interposed between the end of the supporting element 5*c* that is accommodated in the seat 2*c* and the bottom 14 of said seat 2*c*.

More particularly, the screw element 13 has a threaded stem 15 which couples to a female thread formed in a plate 16 which is fixed so as to close the end of the supporting element 5*c* that is accommodated in the seat 2*c,* or to a female thread formed by a nut 17 which is welded to the side of the plate 16 that is directed toward the inside of the supporting element 5*c*. In this case, a through hole is provided in the plate 16 and is crossed by the threaded stem 15 coaxially to the threaded hole of the nut 17. The threaded stem 15 has, at its end that is directed toward the bottom 14 of the seat 2*c,* a hexagonal head 18 which can be operated in order to screw or unscrew the screw element 13, thus varying the length of the part of the screw element 13 that protrudes from the supporting element 5*c* and accordingly varying the extent of the portion of the supporting element 5*c* that protrudes from the seat 2*c*. In practice, by operating the screw element 13 one varies the distance of the resting region 6*c,* and therefore of the second unit 7, from the face 3 of the first unit 4.

The device according to the invention further comprises second adjustment means for varying the elevation of the resting region 6*a,* 6*b,* 6*c* for the second unit 7.

More particularly, as shown in FIGS. 1 to 4, the second adjustment means comprise a second screw element 20 which is associated with the end of the supporting element 5*a,* 5*b,* 5*c* that protrudes from the seat 2*a,* 2*b,* 2*c* and from the face 3 of the first unit 4. The second screw element 20 extends in a substantially vertical direction and forms, with its upper end, the resting region 6*a,* 6*b,* 6*c* for the second unit 7. The screw element 20 has a variable useful length, so as to allow to vary the elevation of the resting region 6*a,* 6*b,* 6*c*.

The second screw element 20 comprises a threaded stem 21 which couples to a female thread formed inside a nut or block 22 which is fixed, for example by welding, to the end of the supporting element 5*a,* 5*b,* 5*c* that protrudes from the seat 2*a,* 2*b,* 2*c*.

If the seat 2*a,* 2*b,* 2*c* and therefore the supporting element 5*a,* 5*b,* 5*c* lie at an angle to the horizontal, a prism-shaped block 23 is provided between the nut 22 and the body of the supporting element 5*a,* 5*b,* 5*c* and allows the second screw element 20 to lie vertically despite the inclination of the supporting element 5*a,* 5*b,* 5*c*.

It should be noted that the female thread with which the threaded stem 21 couples, instead of being formed in a nut 22 which is fixed to the block 23, which is in turn fixed to the end of the supporting element 5*a,* 5*b,* 5*c,* can be formed directly inside the block 23 or the body of the supporting element 5*a,* 5*b,* 5*c*.

The threaded stem 21, at its end that protrudes from the supporting element 5*a,* 5*b,* 5*c,* has a hexagonal head 24 which can be operated in order to turn the threaded stem 21 with respect to the female thread formed in the nut 22 or in the block 23 or in the body of the supporting element 5*a,* 5*b,* 5*c* in order to allow to vary the length of the portion of the threaded stem 21 that protrudes upward from the supporting element 5*a,* 5*b,* 5*c*.

It should be noted that if the seat 2*a,* 2*b,* 2*c* is inclined with respect to the horizontal, the first adjustment means or simply the possibility to move the supporting element with respect to the seat allow to simultaneously vary the horizontal position and the vertical position of the resting region 6. The vertical position of the resting region 6, determined by the movement of the supporting element 5*a,* 5*b,* 5*c* along the seat 2*a,* 2*b,* 2*c,* can then be changed by the second adjustment means.

The shock-absorbing means, in the embodiment illustrated in FIG. 1, comprise a body 30 made of plastically deformable material which is interposed between the first screw element 9 and the face 3 of the first unit 4.

Figure 3:
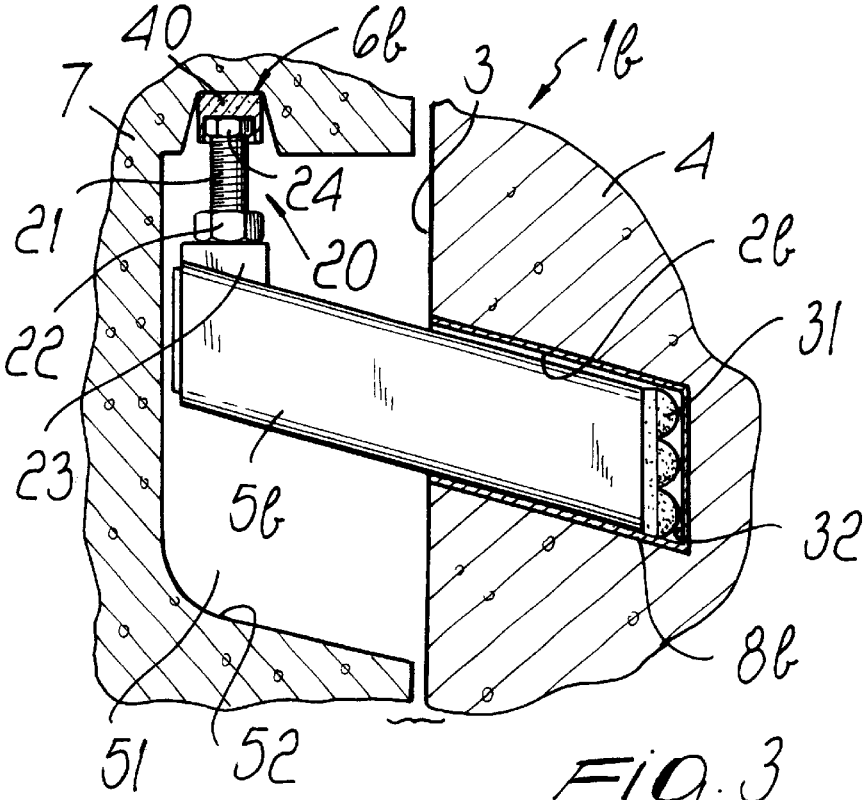
FIG. 3 is a partially sectional side elevation view of the device according to the invention in a second embodiment.

In the embodiment shown in FIG. 3, the shock-absorbing means are instead constituted by a body 31 made of plastically deformable material which is interposed between the end of the supporting element 5*b* that is accommodated in the seat 2*b* and the bottom 32 of the seat 2*b*. In this embodiment, the body 31 is fixed to the end of the supporting element 5*b* that is accommodated in the seat 2*b;* nevertheless, the body 31 might also be fixed to the bottom 32 of the seat 2*b*.

In the embodiment shown in FIG. 4, the shock-absorbing means comprise a body 33 made of plastically deformable material which is interposed between the head 18 of the screw element 13 and the bottom 14 of the seat 2*c*.

In the embodiments shown in FIGS. 1 to 4, the shock-absorbing means also comprise a body 40 made of plastically deformable material which is interposed between the head 24 of the screw element 20 and the region of the second unit 7 that rests on the screw element 20.

The bodies 30, 33, 40 are preferably cap-shaped and are fitted respectively on the head of the screw element 9, of the screw element 13 and of the screw element 20.

Figure 5:
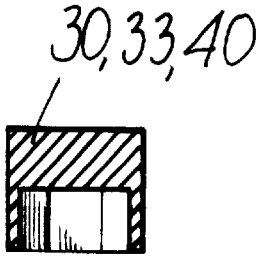
FIGS. 5 to 7 are sectional views, taken along an axial plane, of embodiments of the shock-absorbing means according to the invention.

FIG. 5 is a view of a first embodiment of the bodies 30, 33, 40, according to which the surface by means of which said bodies rest respectively against the face 3 of the unit 4, against the bottom 14 of the seat 2*c* and against the second unit is flat.

Figure 6:
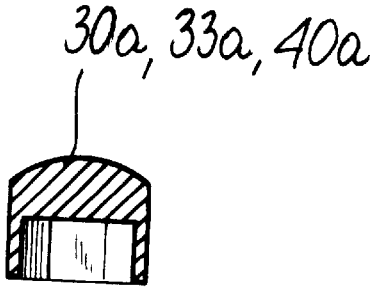

FIG. 6 illustrates a second embodiment of the bodies, designated by the reference numerals 30*a,* 33*a,* 40*a,* according to which the resting surface is provided in the shape of a spherical dome.

Figure 7:
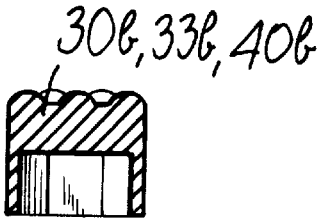

FIG. 7 is a view of a third embodiment of the bodies, designated by the reference numerals 30*b,* 33*b,* 40*b,* according to which the surface has raised portions which are alternated with recesses, so as to achieve better plastic deformability for the body 30*b,* 33*b,* 40*b*. A similar configuration can also be provided for the surface of the bodies 30*b,* 33*b* and 40*b* that rests respectively against the head of the screw element 9, against the head of the screw element 13, and against the head of the screw element 20.

Also the surface of the body 31 that rests against the bottom 32 of the seat 2*b* and/or the surface that rests against the supporting element 5*b* may be shaped like a spherical dome or may have recesses alternated with raised portions for the same purpose.

Substantially, the surfaces of the bodies, which constitute the shock-absorbing means, through which stresses are transmitted from the unit 4 to the unit 7, or vice versa, preferably have a shape with raised portions alternated with recesses, so as to achieve an increase in the plastic deformability of the bodies and therefore so as to achieve a greater effect in stress damping.

If the bodies that constitute the shock-absorbing means are provided with a cap-like configuration and are fitted on the heads of the screw elements 9, 13 and 20, the lateral surface of the bodies is preferably shaped so as to have a hexagonal transverse cross-section, so as to still allow to operate the screw element 9, 13 and 20 easily even though its head is covered by the body 30, 33 and 40.

Figure 8:
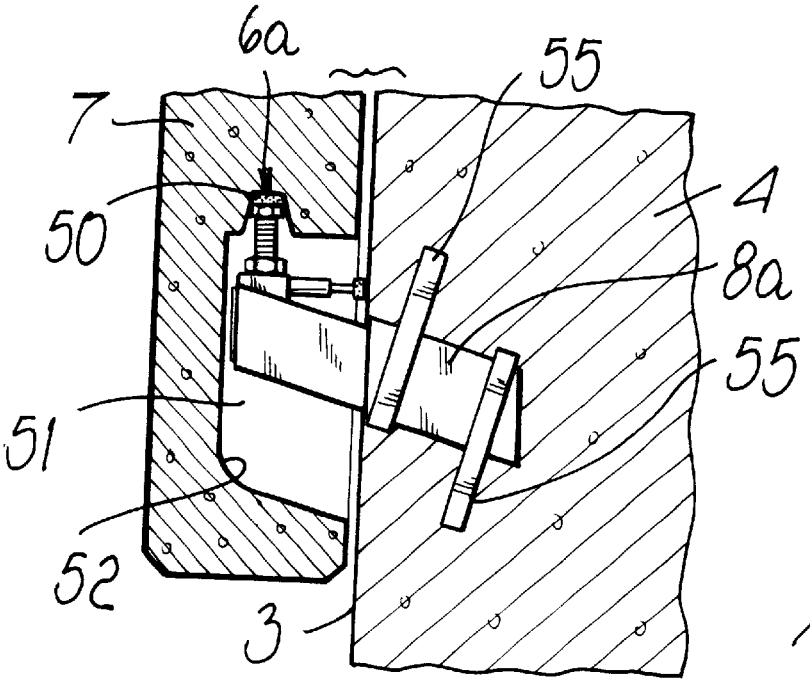
FIG. 8 is a side elevation view of a further embodiment of the device according to the invention, with the units shown in cross-section.

FIG. 8 illustrates an embodiment of the device according to the invention which substantially corresponds to the embodiment shown in FIG. 1, the difference being that the shock-absorbing means, instead of being fitted on the head 24 of the screw element 20, are constituted by a body 50 made of plastically deformable material which is interposed between the head of the screw element 20 and the region of the second unit 7 that rests on said head. Optionally, the body 50 can be fixed to the box 52 that is used in order to form, during the production of the second unit 7, the recess 51 in which the portion of the supporting element 5*a* that protrudes from the first unit 4 is accommodated.

Operation of the device according to the invention is as follows.

The first unit 4 is provided with the seat 2*a,* 2*b,* 2*c,* and during the installation of the units the supporting element 5*a,* 5*b,* 5*c* is inserted in such seat 2*a,* 2*b,* 2*c*.

By acting on the first adjustment means and on the second adjustment means it is possible to vary the distance of the resting region 6*a,* 6*b,* 6*c* from the face 3 of the first unit 4 and the elevation of the resting region 6*a*. In this manner, the second unit 7 that is rested on the resting region 6*a,* 6*b,* 6*c* can be positioned correctly with respect to the first unit 4.

During seismic events, the waves and therefore the stresses that propagate from the first unit 4 to the second unit 7, if the first unit 4 is a supporting unit and the second unit 7 is a supported unit, or vice versa, are reduced significantly by the presence of the shock-absorbing means which, thanks to their plastic deformability, partially or fully absorb the stresses, interrupting their transmission.

If only horizontal stresses are to be damped, it is possible to use only the shock-absorbing means constituted by the bodies 30, 30*a,* 30*b,* 31 and 33, 33*a,* 33*b,* while if only vertical stresses are to be damped, it is possible to use only the shock-absorbing means constituted by the body 40, 40*a,* 40*b* or by the body 50.

For the sake of completeness in description, it should be noted that FIG. 8 also illustrates braces 55 for increasing the anchoring of the cylindrical body 8*b* inside the first unit 4.

The plastically deformable material used to produce the bodies 30, 31, 33 and 40 can be constituted by a synthetic material, for example the material known commercially by the trademark Nylon, or the material known commercially by the trademark Teflon, or other materials which are in any case capable of ensuring the plastic deformability of the bodies 30, 30*a,* 30*b,* 31, 33, 33*a,* 33*b,* 40, 40*a,* 40*b* in case of seismic activity.

In practice it has been observed that the device according to the invention fully achieves the intended aim and objects, since the shock-absorbing means effectively eliminate or substantially reduce the transmission of the stresses produced by seismic activity between the two units that are mutually connected by the device.

Another advantage of the device according to the invention is that it allows to adjust the position of one unit with respect to the other in a very simple and precise manner.

The device thus conceived is susceptible of numerous modifications and variations, all of which are within the scope of the inventive concept; all the details may furthermore be replaced with other technically equivalent elements.

In practice, the materials used, so long as they are compatible with the specific use, as well as the dimensions, may be any according to requirements and to the state of the art.

What is claimed is:

1. A supporting device for prefabricated building components,particularly for prefabricated units made of concrete or the like, comprising a bush-like seat which is formed in one face of a first unit and a supporting element which is detachably inserted in said seat and has an end which protrudes from said seat and from said face of the first unit and forms a resting region for a second unit, further comprising shock-absorbing means which are interposed between said supporting element and said first unit and/or between said supporting element and said second unit, in order to damp vibrations developed according two orthogonal directions, along the surface of the first unit and perpendicularly with respect to said first unit.

2. The device according to claim 1, wherein said supporting element can be moved along said seat in order to vary the distance of said resting region from said face of the first unit.

3. The device according to claim 1, wherein said seat and said supporting element lie at an angle with respect to the horizontal, said supporting element being inclined upward from its end that is inserted in said seat to its end that protrudes from said seat and from said face of the first unit.

4. The device according to claim 1, comprising first adjustment means for varying the length of a portion of said supporting element that protrudes from said seat and from said face of the first unit.

5. The device according to claim 4, further comprising second adjustment means for varying the elevation of said resting region for the second unit.

6. The device according to claim 1, wherein said seat has a polygonal transverse cross-section and said supporting element has a substantially cylindrical shape with a polygonal transverse cross-section which can be coupled with play to said seat.

7. The device according to claim 1, wherein said seat is formed by a hollow body which is embedded in said first unit and is open at said face of the first unit.

8. The device according to claim 1, wherein said supporting element has a tubular body.

9. The device according to claim 1, wherein the end of said supporting element that protrudes from said seat and from said face of the first unit can be accommodated in a recess formed in said second unit.

10. The device according to claim 4, wherein said first adjustment means comprise a first screw element which has an adjustable useful length and is interposed between the portion of said supporting element that protrudes from said seat and said face of the first unit.

11. The device according to claim 4, wherein said first adjustment means comprise a first screw element which has an adjustable useful length and is interposed between the end of said supporting clement that is accommodated in said seat and the bottom of said seat.

12. The device according to claim 5, wherein said second adjustment means comprise a second screw element which is associated with the end of said supporting element that protrudes from said seat and from said face of the first unit, said second screw element being arranged in a substantially vertical direction and forming, with an upper end thereof, said resting region for the second unit, said screw element having a useful length which can vary in order to vary the elevation of said resting region.

13. The device according to claim 10, wherein said shock-absorbing means comprise a body made of plastically deformable material which is interposed between said first screw element and said face of the first unit, and a body made of plastically deformable material which is interposed between the end of said supporting element that is accommodated in said seat and the bottom of said seat.

14. The device according to claim 13, wherein said shock-absorbing means comprise a body made of plastically deformable material which is interposed between said first screw element and the bottom of said seat.

15. The device according to claim 12, wherein said shock-absorbing means comprise a body made of plastically deformable material which is interposed between said resting region, formed by said supporting element, and said second unit.

16. The devise according to claim 13, wherein said body made of plastically deformable material is cap-shaped and is fitted on the end of said first screw element that engages against the face of said first unit.

17. The device according to claim 14, wherein said body made of plastically deformable material is cap-shaped and is fitted on the end of said first screw element that engages against the bottom of said seat.

18. The device according to claim 15, wherein said body made of plastically deformable material is cap-shaped and is fitted on the end of said second screw element that forms said resting region for the second unit.

19. The device according to claim 12, wherein said body made of plastically deformable material is arranged in the region of said recess of the second unit that is meant to rest on said resting region formed by said supporting element.

20. The device according to claim 11, wherein said body made of plastically deformable material is applied to the end of said supporting element that is directed toward the bottom of said seat.

21. The device according to claim 1, wherein at least one of the surfaces of said shock-absorbing means has raised portions which are alternated with recesses in order to increase the plastic deformability of said plastically deformable body.

22. The device according to claim 21, wherein the surface of said plastically deformable body that is in contact with said first unit or with said second unit or with the bottom of said seat or with said supporting element or with said adjustment means is dome-shaped.

* * * * *